United States Patent [19]

Koide et al.

[11] Patent Number: 4,497,140

[45] Date of Patent: Feb. 5, 1985

[54] CAM GRINDING MACHINE

[75] Inventors: Tsuyoshi Koide, Toyota; Toshio Maruyama; Toshio Tsujiuchi, both of Kariya, all of Japan

[73] Assignee: Toyoda Koki Kabushiki Kaisha, Kariya, Japan

[21] Appl. No.: 403,509

[22] PCT Filed: Mar. 27, 1982

[86] PCT No.: PCT/JP82/00082

§ 371 Date: Jul. 12, 1982

§ 102(e) Date: Jul. 12, 1982

[87] PCT Pub. No.: WO82/03592

PCT Pub. Date: Oct. 28, 1982

[30] Foreign Application Priority Data

Apr. 20, 1981 [JP] Japan ..... 56-58452

[51] Int. Cl.[3] ..... B24B 17/02

[52] U.S. Cl. ..... 51/101 R

[58] Field of Search ..... 51/101 R, 101 LG; 74/675, 781 R, 785

[56] References Cited

U.S. PATENT DOCUMENTS

| | | | |
|---|---|---|---|
| 2,621,544 | 12/1952 | Rossmann | 74/675 |
| 3,088,335 | 5/1963 | Bullard | 74/675 |
| 3,621,614 | 11/1971 | Hikita et al. | 51/101 R |
| 3,683,558 | 8/1972 | Oishi | 51/101 R |
| 3,844,068 | 10/1974 | Shiga et al. | 51/101 R |
| 3,861,484 | 1/1975 | Joslin | 74/675 X |
| 4,121,385 | 10/1978 | Asano | 51/101 R |
| 4,358,911 | 11/1982 | Vogelsanger | 51/101 R |

*Primary Examiner*—Robert P. Olszewski

*Attorney, Agent, or Firm*—Oblon, Fisher, Spivak, McClelland & Maier

[57] ABSTRACT

A cam grinding machine for grinding a cam in accordance with the profile of a master cam (6). The machine is equipped with an apparatus for substantially compensating lift error of the cam due to grinding wheel wear, said apparatus being provided with a planetary gear mechanism (30) so as to change a large diameter roller (22) contacting the master cam (6) into a small diameter roller (23) when the grinding wheel diameter is reduced.

7 Claims, 4 Drawing Figures

CAM GRINDING MACHINE

DESCRIPTION

1. Technical Field

The present invention relates to a cam grinding machine for grinding a cam corresponding to a master cam and, more particularly, to a cam grinding machine which is capable of compensating for the lift error of a cam product due to wear of a grinding wheel.

2. Background Art

In general, in a system for grinding a cam upon a workpiece by reproducing or duplicating a master cam, a lift error is caused upon a cam product corresponding to the changes in the grinding point of the cam product and a wheel surface in accordance with alterations in the curvature of the grinding wheel which is caused by a reduction in its diameter due to wear of the grinding wheel.

In order to compensate for or eliminate the lift error due to grinding wheel wear, it has been proposed to alter the diameter of a cam roller which is brought into contact with the master cam when the diameter of the grinding wheel is reduced due to wear. As a means for altering or changing the cam roller diameter, various kinds of apparatuses have been proposed, such as disclosed in U.S. Pat. No. 3,844,068.

Such apparatuses are generally classified into first and second systems as described below. In the first system, two cam rollers of different diameters are mounted on a roller support wherein the cam rollers are adapted to be shifted relatively to the roller support to change over from the large diameter roller to the small diameter roller. However, the large diameter roller and the small diameter roller must be slid along the axial direction at the surface rotatably supporting the rollers, so that a relatively large clearance has to be maintained at the surface for rotatably supporting the rollers. As a result, this first system has a disadvantage in that the bearing rigidity of the rollers cannot be increased up to a high level.

In the second system, the roller support mounting the large and small diameter rollers is adapted to be shifted by an amount equal to one half of the pitch of the master cams so as to change over from the large diameter roller to the small diameter roller. Further, in this system, a star gear and a dog are provided respectively on a traverse table and a bed so that the cam rollers are shifted by an amount equal to the pitch of the master cams to contact the master cams on after another each time the traverse table is indexed. Therefore, in order to accomplish the above changing over process, the star gear must be released from the engagement with the dog so as to rotate the star gear independently, or, in the case where the star gear is always engaged with the dog, a shaft of the star gear must be axially shifted so as to release meshing of a rack provided on the roller support with a gear mounted on the shaft of the star gear and to rotate an intermediate gear meshing with the rack.

In the former case where the shaft of the star gear is not locked, the location of the cam rollers with respect to the master cam would be out of proper alignment if the star gear were rotated by exertion of an external force, introducing fears of introducing problems to the cam grinding process. Also, in the latter case where the star gear is always engaged with the dog and the roller support is shifted after temporarily releasing the coupling of the rack with the star gear shaft, there is a fear that phase in meshing of the rack and the gear of the star gear shaft will be changed when the rack is recoupled with the star gear shaft, resulting in a problem similar to that experienced in the former case where the star gear shaft is not locked.

DISCLOSURE OF THE INVENTION

The present invention is to permit changing over from the large diameter roller to the small diameter roller without releasing meshing of the gears while locking the shaft of the star gear in the above-mentioned second system, that is, in such a system that the roller support itself is shifted not only to bring a cam roller into engagement with master cams upon indexing of the traverse table but also change over the cam rollers, thereby to overcome to above-described problems of the prior art. To this end, according to the present invention, there is provided a cam grinding machine comprising: a bed; a traverse table slidably mounted on said bed for indexing a workpiece to be ground by a grinding wheel; a swingable support pivotably mounted on said traverse table; a plurality of master cams mounted on said swingable support to be rotatable synchronously and coaxially with said workpiece; a roller support mounted on said traverse table to be movable in the direction parallel to the axis of said master cams; a large diameter cam roller and a small diameter cam roller supported on said roller support and located to have a distance therebetween different from a pitch of said master cams; urging means for urging said master cams toward said cam rollers to make contact between one of said cam rollers and one of said master cams so as to generate a cam profile on said workpiece; and cam roller moving means operable to move said roller support so as to bring one of said cam rollers into engagement with one of said master cams, characterized in that said cam roller moving means comprises: a rack secured to said roller support; a star gear shaft rotatably mounted on said traverse table; a star gear rigidly provided on said star gear shaft; dogs secured to said bed and meshing with said star gear; a planetary gear mechanism provided with a sun gear for operably connecting said rack with said star gear; and driving means for rotating said sun gear so as to move said roller support by an amount equal to said distance with respect to one of said master cams when said star gear is prevented from rotating due to the engagement with said dogs, and for preventing the rotation of said sun gear so as to move said roller support by an amount equal to said pitch through the engagement of said star gear with said dogs when said traverse table is slid for indexing said workpiece.

As described hereinbefore, according to the present invention, an arrangement is obtained such that a planetary gear mechanism is disposed between a rack mounted on a roller support and a star gear shaft used for shifting the location of a roller support with respect to master cams with indexing of a traverse table, and is operated to properly effect coupling therebetween, thus permitting changing over of the cam rollers while maintaining engagement of a star gear with a dog or holding the star gear in a locked state, and hence eliminating a need for additional meshing and releasing of gears. This sequence is advantageous in that the position of the roller support is not out of the desired location, and the cam rollers are properly located to have the same phase as that of the master cam at all times, thus effecting an assured cam grinding process.

BEST MODE FOR CARRYING OUT THE INVENTION

Figure 1:
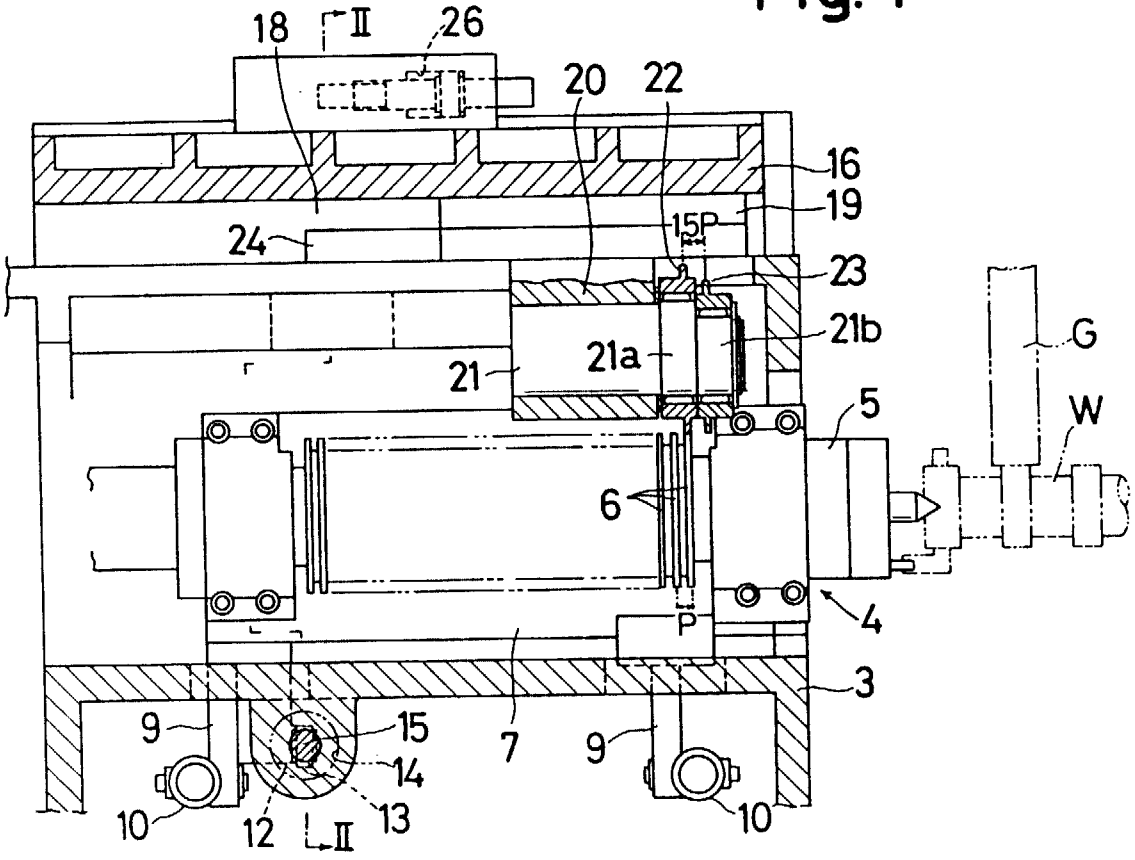
FIG. 1 is a plan sectional view of a cam grinding machine according to the present invention.
Figure 2:
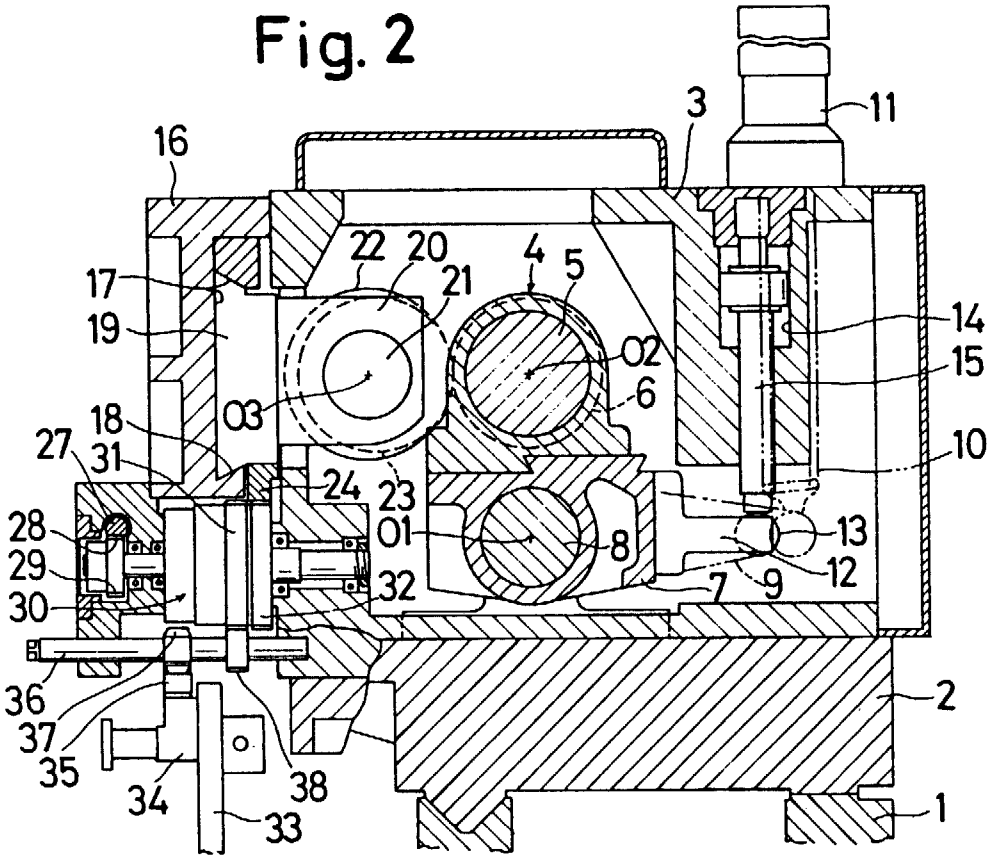
FIG. 2 is a sectional view taken along the line II—II in FIG. 1.

In the following, a preferred embodiment of the present invention will be described with reference to the accompanying drawings. Referring to FIGS. 1 and 2, reference numeral 1 designates a bed, 2 designates a traverse table ( hereinafter referred to simply as table ) slidably placed on the bed 1, 3 is an integral spindle stock body provided on the table 2, and 4 is a swingable spindle stock provided in the spindle stock body 3 in a swingable manner.

Figure 3:
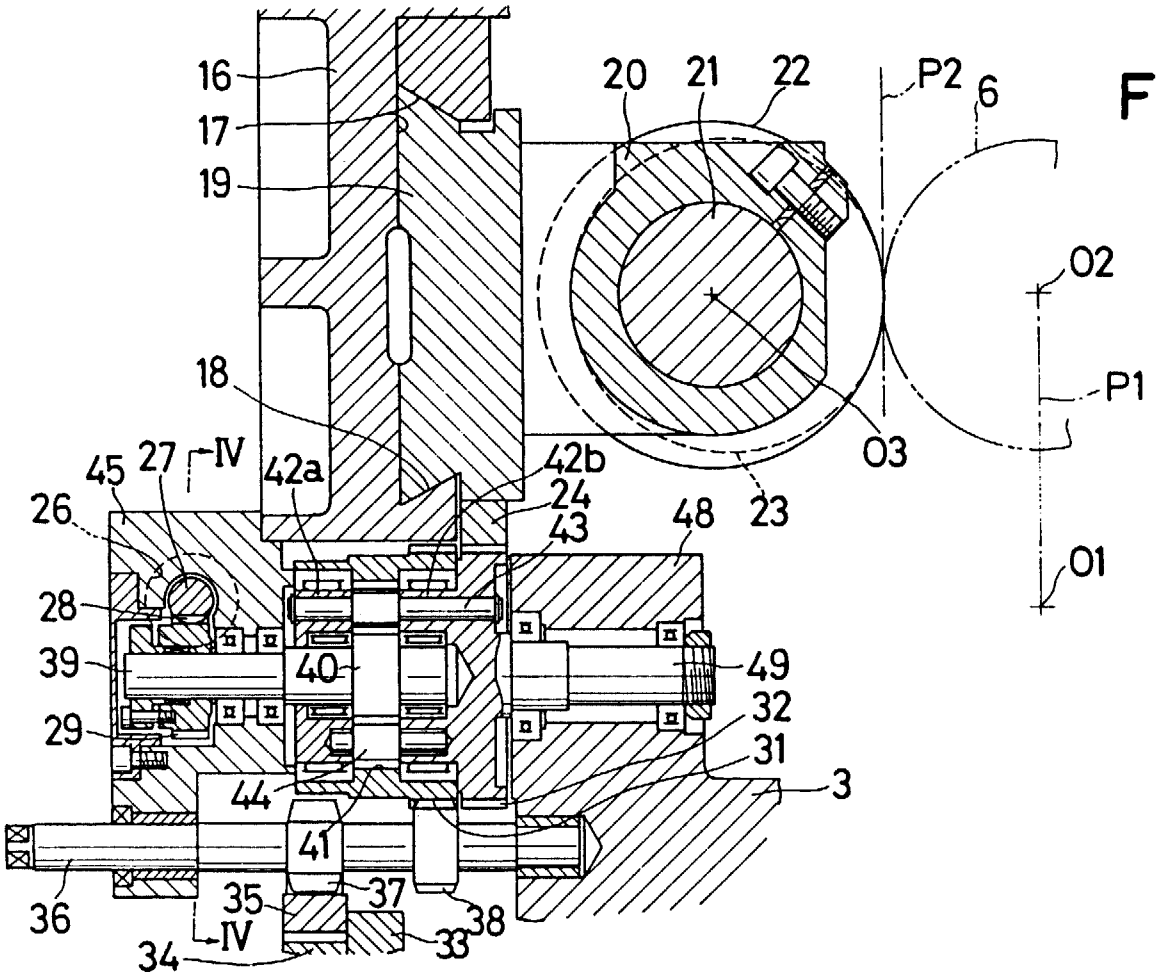
FIG. 3 is an enlarged sectional view showing essential parts of the machine according to the present invention and FIG. 4 is an enlarged view taken along the line IV—IV in FIG. 3.

The swingable spindle stock 4 is arranged so that a swingable support 7 is mounted in a swingable manner via a supporting shaft 8 held by bearings projecting from the spindle stock body 3 and a spindle 5 including master cams 6 fitted thereon is rotatably supported by the swingable support 7 via bearings. As shown in FIG. 3, the spindle 5 and the supporting shaft 8 are disposed in such a manner that the center axis 01 of swing motion and the center axis 02 of rotation of the spindle 5 generally extend to be included in a common vertical plane P1. A workpiece W, such as, for example, a cam shaft having several cam portions, is supported at one end of the spindle 5 in a well-known manner so as to be ground by a grinding wheel G, wherein the master cams 6 are rotated synchronously and coaxially with the workpiece W.

An arm 9 is rigidly fastened to the side of the swingable support 7, and a spring 10 is provided between the arm 9 and a spring support 11 provided at the upper portion of the spindle stock body 3 in an adjustable manner in the vertical direction. The tensile force of the spring 10 imparts a rotational moment to the swingable support 7 and then contact pressure between the master cam 6 and cam rollers 22 and 23, described below. The lower end of a piston rod 15 of a cylinder 14 for returning the swingable support 7, which is provided in the spindle stock body 3, is brought into abuttment with a roller 13 at the end of a roller supporting arm 12 projecting from the side of the swingable support 7 and pushes the roller supporting arm 12 downward, whereby the swingable support 7 is inclined against the tensile force of the spring 10 and hence the master cam 6 is separated from the large diameter roller 22 or the small diameter roller 23.

A guide member 16 provided integrally with the spindle stock body 3 is formed with dovetail slots 17, 18 along which a roller support 20 is guided through a sliding member 19, so that the roller support 20 is movable in parallel with the axis 02 of the spindle 5. The large and small diameter rollers 22 and 23 are rotatably supported by the roller support 20 through a supporting shaft 21. In order to compensate for the lift error within an allowable tolerance, the large diameter roller 22 is used in the range where the grinding wheel radius is larger than a predetermined value, while the small diameter roller 23 is used in the range where the grinding wheel radius is reduced to be smaller than that due to wear. The supporting shaft 21 is rigidly supported by the roller support 20. The large diameter roller 22 is rotatable supported by an end portion 21*a* concentric with the supporting shaft 21, while the small diameter roller 23 is rotatably supported by an end portion 21*b* eccentric from the center of the supporting shaft 21 by a predetermined amount, so that one point of the peripheral surfaces of both of the rollers 22 and 23 is always tangent to a common plane P2, as shown in FIG. 3. The common plane P2 may be a vertical plane in the case where the axis 02 of the master cams 6 and the axis 03 of the supporting shaft 21 are generally included in a horizontal plane. The large and small diameter rollers 22, 23 are disposed along the axial direction of the spindle 5 to have a pitch or a distance 1.5P therebetween with respect to the pitch P of the above-mentioned master cams 6, so that when either one of these rollers 22 and 23 is brought into contact with one of the master cams 6, the other roller does not interfere with the adjacent master cam 6. Furthermore, the roller support 20 is indexed and moved to position allowing either one of the large and small diameter rollers 22, 23 to be brought into contact with the master cam 6 through a changing over mechanism which will be described later on. In this connection, it is to be noted that the distance between the large diameter roller 22 and the small diameter roller 23 may be a distance equal to 0.5 pitch or one half of the pitch P of the master cams 6 for the purpose of eliminating the interference as stated above.

Figure 4:
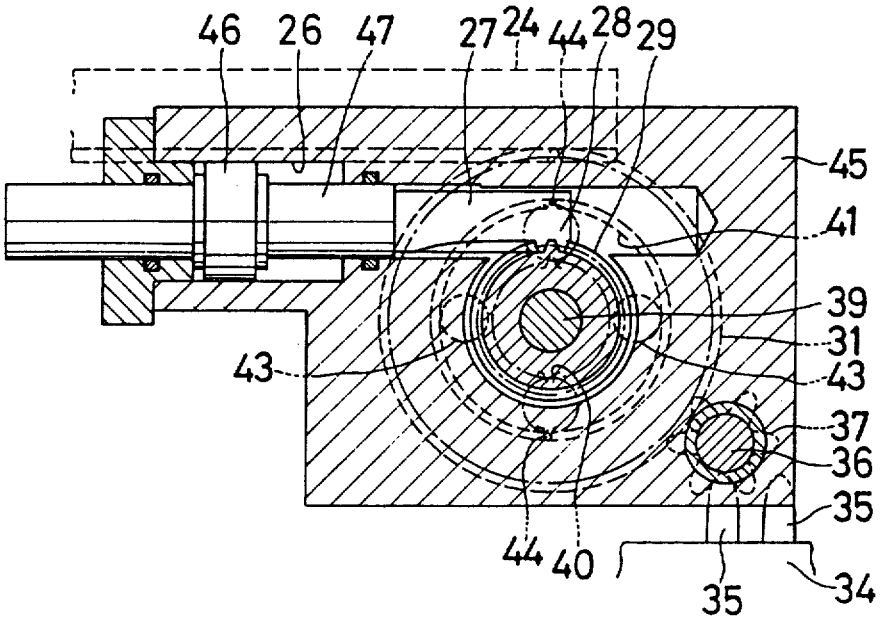

An indexing mechanism for the roller support 20 constituting the essential part of this invention will be described hereinafter referring to FIGS. 3 and 4 additionally. A rack 24 is fixed to the lower surface of the sliding member 19. Also, a rail support 33 rigidly fastened to the bed 1 includes a dog rail 34, to which a plurality of dogs 35 are fixed with a predetermined space therebetween. One of the dogs 35 is engaged with a star gear 37 provided on a star gear shaft 36 rotatably mounted to a supporting block 45 which is coupled to the spindle stock body 3.

Between the star gear shaft 36 and the rack 24 is provided a planetary gear mechanism 30 having the following arrangement: A sun gear shaft 39 is rotatably mounted to the supporting block 45 parallel to the star gear shaft 36. A sun gear 40 is attached on the sun gear shaft 39. A first planet gear support 42*a* is rotatably mounted on the sun gear shaft 39.

A second planet gear support 42*b* has a shaft 49 supported by a bearing 48 provided integrally with the spindle stock body 3 and is rotatably mounted on the sun gear shaft 39. The sun gear 40 is located between the first planet gear support 42*a* and the second planet gear support 42*b*. Both planet gear supports 42*a* and 42*b* are integrally coupled to each other by connecting shafts 43 and also rotatably mount planet gears 44 meshing with the sun gear 40 and an internal gear 41. The internal gear 41 mounted at the outer periphery of the first and second planet gear supports 42*a* and 42*b* includes an external gear 31 formed at the outer periphery thereof and meshing with a gear 38 mounted on the star gear shaft 36. Meanwhile, the rack 24 rigidly fastened to the lower surface of the sliding member 19 is in engagement with a pinion 32 formed on the second planet gear support 42*b*.

A cylinder 26 for shifting with its axis perpendicular to the sun gear shaft 39 is installed in the supporting block 45 and a piston 46 is fitted in the cylinder 26 for shifting, the piston 46 including an integrally attached piston rod 47 which is provided with a rack bar 27 having a rack 28 thereon. Then, the rack 28 is in engagement with a pinion 29 rigidly fastened on the sun gear shaft 39, so that the sun gear shaft 39 is rotated by a predetermined amount upon axial movement of the piston 46.

The indexing operation of the cam rollers 22 and 23 constituting the essentials of the present invention will now be described. Since the workpiece W shown in FIG. 1 is subjected to a cam producing motion comprising the combined rotary and swing motions in accordance with the profile of the master cam 6, the grinding wheel may be simply fed in until the workpiece W has been ground up to the finishing size. During the initial stage of the operation, the large diameter roller 22 is in contact with one of the master cams 6, while the star gear 37 is engaged with one of the dogs 35, whereupon a grinding process may be performed in a manner similar to that of a conventional machine. After the completion of the grinding process of a cam portion of the workpiece W, the table 2 is indexed or, in other words, shifted by a predetermined distance to grind an adjacent cam portion, and, at the same time, the large diameter cam roller 22 is positioned so as to contact the adjacent master cam 6 in the following manner. Upon indexing of the table 2, the star gear 37 rotates the star gear shaft 36 through engagement with the dogs 35 and hence the gear 38 rotates the internal gear 41 through engagement with the external gear 31 by a predetermined amount. At this time, the sun gear shaft 39 is prevented from rotating by the rack bar 27 extending from the piston rod 47 of the cylinder 26 for shifting and is locked, so that the planet gear 44 meshing with the internal gear 41 turns on its axis while revolving around the sun gear 40 so as to rotate the first and second planet gear supports 42*a* and 42*b*. Accordingly, the sliding member 19 is moved with the rotation of the pinion 32 on the second planet gear support 42*b* via the rack 24 meshing with the pinion 32, and upon this the large diameter roller 22 is shifted by one pitch P to have the same phase as the adjacent master cam 6 mounted on the spindle 5. In this manner, the workpiece W is ground to produce cams one after another, while the grinding wheel G is properly dressed and its diameter is reduced accordingly. The diameter of the grinding wheel G may be displayed with a counter or the like, or the amount of wear of the grinding wheel G is detected by means of such as a limit switch for detecting the position of a dressing tool. Upon the result of such measurement or detection, the cam roller is changed over from the large diameter roller 22 to the small diameter roller 23.

For the changing over operation, when the table 2 is returned to the original position, pressurized oil is supplied to the shifting cylinder 26 so as to rotate the sun gear shaft 39 by a predetermined amount via the rack bar 27 and the pinion 28. At this time, the star gear shaft 36 is prevented from rotating by engagement of the star gear 37 with the dog 35 and is locked, so that the external gear 31 meshing with the gear 38 is not rotated and the sun gear 40 is rotated. Rotation of the sun gear 40 turns the planet gear 44 on its axis through meshing with the internal gear 41 while revolving around the sun gear 40, whereby torque is transmitted to the first and second planet gear supports 42*a* and 42*b* so as to move the sliding member 19 via the pinion 32 and the rack 24 and hence to shift the roller support 20 by one and half of the pitch P. As a result, the small diameter roller 23 is located so as to have the same phase as that of the master cam 6. The thus located position becomes the original position of the table 2 for the grinding process using the small diameter roller 23. Then, the roller support 20 is shifted sequentially by one pitch P through engagement of the star gear 37 with the dogs 35 upon indexing of the table 2, and the cam portions of the workpiece W are ground one after another as stated above using the small diameter roller 23. In this connection, when moving the roller support 20 by one pitch P with respect to the master cams 6 by indexing the table 2, and changing over from the large diameter roller 22 to the small diameter roller 23, the roller supporting arm 12 is pushed down with the piston rod 15 of the cylinder 14 for returning the swingable support 7, so that the master cams 6 are separated from the large diameter roller 22 or the small diameter roller 23.

What is claimed is:

1. A cam grinding machine comprising:

a bed;

a traverse table slidably mounted on said bed for indexing a workpiece to be ground by a grinding wheel;

a swingable support pivotably mounted on said traverse table;

a plurality of master cams mounted on said swingable support and rotatable synchronously and coaxially with said workpiece;

a roller support mounted on said traverse table to be movable in the direction parallel to the axis of said master cams;

a large diameter cam roller and a small diameter cam roller supported on said roller support and spaced from one another by a distance different from a pitch of said master cams in the axial direction of said master cams;

urging means for pivotably urging said swingable support to bring said master cams into contact with one of said cam rollers so as to generate a cam profile on said workpiece during rotation of said master cams; and cam roller moving means for moving said roller support so as to bring one of said cam rollers into face to face relation with one of said master cams, said cam roller moving means including:

a rack secured to said roller support;

a star gear shaft rotatably mounted on said traverse table and having a star gear fixedly provided thereon;

dogs secured to said bed for selective meshing with said star gear;

a planetary gear mechanism having a sun gear for operably connecting said rack with said star gear; and driving means composed of a linear motion cylinder device for rotating said sun gear so as to move said roller support by an amount equal to said distance in the axial direction of said master cams when said star gear is prevented from rotating due to the engagement with one of said dogs, and for preventing the rotating of said sun gear so as to move said roller support by an amount equal to said pitch through the engagement of said star gear with one of said dogs when said traverse table is slid for indexing said workpiece.

2. A cam grinding machine as set forth in claim 1 wherein said planetary gear mechanism (30) comprises:

a planet gear support (42*a*, 42*b*) rotatably supported by said traverse table (2) and rotatably mounting said sun gear (40);

a planet gear (44) rotatably supported by said planet gear support (42*a*, 42*b*) and meshing with said sun gear (40);

an internal gear (41) rotatably supported by said planet gear support (42*a*, 42*b*) so as to mesh with said planet gear (44) and provided with an external gear (31);

a gear (38) provided on said star gear shaft (36) for meshing with said external gear (31); and a pinion (32) provided on said planet gear support (42*a*, 42*b*) for meshing with said rack (24).

3. A cam grinding machine as set forth in claim 2, wherein said driving means (27, 28, 29, 39) comprises:

a sun gear shaft (39) provided with said sun gear (40) and rotatably supported by said traverse table (2);

a second pinion (29) provided on said sun gear shaft (39);

a piston rod (27, 47) slidably supported by said traverse table (2); and a second rack (28) provided on said piston rod (27, 47) so as to mesh with said second pinion (29) for rotating said sun gear (40).

4. A cam grinding machine as set forth in claim 3, wherein said large diameter cam roller (22) and said small diameter cam roller (23) are disposed eccentrically with respect to each other, so that one point of the peripheral surfaces of both of said rollers (22, 23) is always tangent to a common plane.

5. A cam grinding machine as set forth in claim 4, wherein said urging means (10, 11) comprises:

a spring (10), and a spring support (11) mounted on said traverse table (2) for adjustably supporting said spring (10).

6. A cam grinding machine as set forth in claim 5, wherein said distance between said large diameter cam roller (22) and said small diameter cam roller (23) is one and half of said pitch (P) of said master cams (6).

7. The cam grinding machine of claim 1 wherein said planetary gear mechanism also includes a planet gear carrier rotatably mounted on said traverse table.

* * * * *